US009440816B2

(12) United States Patent
Stojanovski et al.

(10) Patent No.: US 9,440,816 B2
(45) Date of Patent: Sep. 13, 2016

(54) SYSTEMS AND METHODS FOR IMPLEMENTING UNIQUE STACK REGISTRATION USING ROTATING SHELF STRUCTURES FOR SET COMPILING IN IMAGE FORMING DEVICES

(71) Applicant: XEROX Corporation, Norwalk, CT (US)

(72) Inventors: Billy T. Stojanovski, Penfield, NY (US); Gerald Roy Curry, Lima, NY (US); Thomas Crofton Hatch, Williamson, NY (US); Todd Maurice Uthman, Rochester, NY (US); Donald R. Fess, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 157 days.

(21) Appl. No.: 14/074,658

(22) Filed: Nov. 7, 2013

(65) Prior Publication Data

US 2015/0125255 A1 May 7, 2015

(51) Int. Cl.
*B65H 31/30* (2006.01)

(52) U.S. Cl.
CPC ... *B65H 31/3018* (2013.01); *B65H 2301/4212* (2013.01); *B65H 2301/4213* (2013.01); *B65H 2301/422615* (2013.01); *B65H 2404/66* (2013.01); *B65H 2404/6922* (2013.01); *B65H 2801/06* (2013.01)

(58) Field of Classification Search
CPC ..... B65H 29/26; B65H 29/34; B65H 29/42; B65H 31/30; B65H 31/3009; B65H 31/3018; B65H 31/3054; B65H 2301/422; B65H 2301/4226; B65H 2301/42261; B65H 2301/422615; B65H 2301/42264; B65H 2404/66; B65H 2404/662
See application file for complete search history.

(56) References Cited

U.S. PATENT DOCUMENTS

| | | | | |
|---|---|---|---|---|
| 4,183,704 | A * | 1/1980 | Steinhart | 414/788.3 |
| 4,938,657 | A * | 7/1990 | Benson et al. | 414/790.4 |
| 5,580,041 | A * | 12/1996 | Nakayama | 271/189 |
| 5,906,367 | A * | 5/1999 | Takagaki | 271/218 |
| 7,052,006 | B2 * | 5/2006 | Stauber et al. | 270/58.31 |
| 2009/0110458 | A1 * | 4/2009 | Sato | 399/405 |

FOREIGN PATENT DOCUMENTS

EP 1726549 A1 * 11/2006

* cited by examiner

*Primary Examiner* — Ernesto Suarez
(74) *Attorney, Agent, or Firm* — Ronald E. Prass, Jr.; Prass LLP

(57) ABSTRACT

A system and method are provided for improving stack integrity for a set of image receiving media substrates at an output of a compiler in an image forming device positioning a plurality of pairs of rotating shelf structures in a vicinity of an exit/ejection port of an image receiving media processing or post-processing unit. The plurality of pairs of rotating shelf structures cycle between a first (support) position and a substantially orthogonal second (drop) position with respect to a rotating axis for the rotating shelf structures. Each of the rotating shelf structures has a uniquely-portioned top surface that includes a substantially-parallel top (supporting) portion and a ramped lead-in portion facing the exit/ejection port from the image receiving media processing or post-processing unit in an effort to reduce any image receiving media substrate "stubbing" against a first of the plurality of pairs of rotating shelf structures in a process direction.

14 Claims, 6 Drawing Sheets

SYSTEMS AND METHODS FOR IMPLEMENTING UNIQUE STACK REGISTRATION USING ROTATING SHELF STRUCTURES FOR SET COMPILING IN IMAGE FORMING DEVICES

BACKGROUND

1. Field of Disclosed Subject Matter

This disclosure relates to systems and methods for improving stack registration with regard to sets of image receiving media substrates at an output of an image receiving media processing or post-processing unit in an image forming device by employing a plurality of pairs of rotating shelf structures to implement substrate support and vertical substrate set movement in the image forming device.

2. Related Art

Many modern image forming devices are comprised of myriad discrete component sub-systems. These discrete component sub-systems include (1) image receiving media supply components at an input end of the image forming device, (2) pre-processing and/or conditioning components for preparing surfaces of the image receiving media substrates to receive marking material to form images, (3) a marking material delivery component for depositing marking materials on the surfaces of the image receiving media substrates to form the images according to input or read image signals, (4) fusing/finishing components for fixing the deposited marking materials on the image receiving media substrates, and (5) post-processing devices for carrying out certain post processing tasks including compilers for collating the image receiving media substrates as sets comprising multi-page finished documents, for example, for stapling or otherwise binding the multi-page finished documents.

The individual component sub-systems are generally interconnected by a series of increasingly intricate image receiving media substrate transport sub-systems, paths and/or components. The image receiving media transport sub-systems, paths and/or components are generally designed and implemented in particular office-sized image forming devices in a manner that manages a size footprint for the image forming devices while not specifically limiting the transport requirements from an output of one component sub-system to an input of another component sub-system.

At an end of the processing scheme, the form and function of the image receiving media transport sub-systems, paths and/or components often become somewhat more narrowly defined. The print job is generally completed with individual sheets of image receiving media substrates, with the images formed and fixed thereon, being collected in sets at a compiler tray that may be associated with one or more of the post-processing sub-systems. Manipulation of the individual image receiving media substrates, or of the sets of image receiving media substrates, at that point in the processing of the documents responsive to the directed print job can be particularly intricate. There is often a need to ensure that the sets of image receiving media substrates are fairly precisely handled, stacked, and/or registered in order to facilitate one or more post-processing or finishing processes including, for example, stapling or binding.

Certain currently-fielded systems may be configured with what may generally be described as vertical compiler sub-systems. FIG. 1 illustrates a simple schematic representation of a side view of an exemplary system 100 incorporating a commonly-implemented vertical compiler. FIG. 2 illustrates a simple schematic representation of a top plan view of an exemplary system 100 incorporating the same commonly-implemented vertical compiler shown in FIG. 1. As shown in FIGS. 1 and 2, individual sheets of image receiving media substrate 130 exit an imaging system processing/post-processing device 110 at an exit/ejection port 115 and are individually deposited in an output (compiler) tray 120.

A "bottom" or platform of the output (compiler) tray 120 may consist of a plurality of longitudinally-arranged image receiving media substrate supports that extend in the process (longitudinal) direction of the image receiving media substrate 130. The image receiving media substrate 130 rests on the substrate supports and is generally manually recoverable from the substrate supports.

In exemplary systems such as that shown in FIGS. 1 and 2, vertical set compiling may occur in one or more stages as follows. Individual image receiving medium substrate(s) 130 may be dropped in stages from the output (compiler) tray 120, acting as a temporary compiler. This dropping may be effected, by laterally-opposing motions, i.e., orthogonal to the process direction, of the plurality of longitudinal image receiving media substrate supports (or arms) toward opposed lateral edges of the output (compiler) tray 120, displacing the substrate supports from under the image receiving media substrate 130. As a result of the linear movement of the plurality of longitudinal image receiving media substrate supports, each of the image receiving media substrates 130 drops down to an image receiving medium set receiving platform, or an output set collection platform component 150.

The image receiving media substrates 130 may be collected as a set 140 on the output set collection platform component 150. The output set collection platform component 150 may be, in turn, comprised of at least a pair of compiler shutters 152/154. Each sheet of image receiving media substrates 130 in the set is dropped in a similar fashion to create the set 140 of image receiving media substrates on the compiler shutters 152/154. When the set 140 of image receiving media substrates is complete and properly registered, and optionally, for example, bound or stapled, the set 140 of image receiving media substrates is then dropped onto a stack of previously-dropped sets 170 of image receiving media substrates, or directly onto some manner of set output transport path 160 to be moved in a process direction B from a first stack position to a second stack position 180 and beyond.

The above-described dropping function is currently undertaken in commonly-implemented vertical compiler sub-systems by rapid cycling of the compiler shutters 152/154 in opening and then closing in mechanically opposing linear motions.

SUMMARY OF THE DISCLOSED EMBODIMENTS

Operating and processing speeds for completing intricate print jobs in complex image forming systems continue to increase. The demands for precision in registration and alignment of sets of documents remain very high. This combination of factors places ever increasing stress on rapidly linearly reciprocating components in conventional systems causing mechanical components to fail. Also, as reciprocating mechanical components, including compiler shutters, are caused to move at increased speeds, disturbances may be introduced that may adversely affect the efforts to precisely align the stacks of image receiving media substrates comprising each set. Abrupt movements of the shutters, for example, may cause the image receiving media substrates to be displaced slightly with the movement of the shutters. Additionally, rapid reciprocating movements may introduce airflows at relatively higher velocities that may cause the individual image receiving media substrates to be fluffed, fluttered and skewed in a random manner. These functional difficulties may increase demands placed on longitudinal (trailing edge) and lateral (side) tampers as these components are, in turn, called upon to routinely react more rapidly to correct increasingly frequent and extensive alignment errors, at often increasingly disturbing rapidly reciprocating linear motions.

It is, therefore, generally recognized by those of skill in the art that the above-described drop functions will tend to introduce variation in set registration in the first individual sheet drop stage and the set-to-set (stack) registration in the second drop stage. U.S. patent application Ser. No. 14/039,045, entitled "Systems and Methods For Implementing An Auger-Based Transport Mechanism For Vertical Transport Of Image Receiving Media In Image Forming Systems," to Herrmann, which is commonly assigned and the disclosure of which is hereby incorporated by reference herein in its entirety, describes an auger-based vertical transport system for uniquely addressing shortfalls in conventional vertical transport components.

In certain currently-fielded image forming devices and image forming systems, particularly for use in an office environment, internal vertical compilers often suffer some measure of compromise with regard to internally compiled set integrity that is associated with a conventional compiler tray configuration. In such configurations, a trail edge of individual image receiving media substrates being compiled as a set rests nominally in a range of 7-30 mm below a lead edge in the compiler throat. A disadvantageous result of this vertical compiler configuration then is that, when side tamping is applied to a compiled set image receiving media substrate, bottom sheets are often caused to "walk back." This walk back further results in poor in-set registration in a process direction. Additionally, as small stapled sets (<20 sheets) of image receiving media substrates build-up on an accumulated stack of sets below, the increased thickness due to the stapling can eventually build to a point where the stack interferes with the compiling sets, causing further height differential and exacerbating the problem.

Previous methods that have been applied to attempt to address and alleviate compiler congestion issues resulting from the above-described differential stacking heights have included the use of compiler shutters, as generally described above, on a basic finisher module (BFM). A difficulty with these currently-attempted "solutions" is that operating and processing speeds for completing print jobs in the involved image forming devices continue to increase. The demands for precision in registration and alignment of sets of documents remain very high. This combination of factors places ever increasing stress on conventional linearly reciprocating component systems causing mechanical components to fail. Also, as linearly reciprocating mechanical components, including compiler shutters, are caused to move at increased speeds, greater disturbances may be introduced that may adversely affect the efforts to precisely align the stacks of image receiving media substrates comprising each set. Abrupt movements of the shutters, for example, may cause the image receiving media substrates to be displaced slightly with the movement of the shutters as described above. The conventional shutter-based configurations are considered not to be able to work effectively in certain devices due to productions speeds, e.g., at upwards to 157 ppm.

It would be advantageous in view of the above-noted image receiving medium handling difficulties arising from increasingly high speed document preparation requirements and the significantly increased mechanical stresses placed on linearly reciprocating components to expand an array of solutions beyond those described and depicted in the 045 application to afford system designers and manufacturers an additional range of freedom in designing and manufacturing vertical compiler mechanisms. An objective may be to develop additional electro-mechanical structures by which to optimize movement of vertically moved image receiving media substrates and sets of image receiving media substrates in a manner that reduces and/or slows overall mechanical component movement, and particularly high speed reciprocating movement, of certain components in the vertically-configured image receiving media transport paths.

Exemplary embodiments of the systems and methods according to this disclosure may provide additional structures to facilitate vertical movement of individual substrates and sets of substrates in a compiler section that are particularly configured to incorporate pairs of rotating shelf elements to support a full length of the sheets of image receiving media substrates being compiled.

Exemplary embodiments may provide a plurality of pairs of rotating shelf structures to support multiple sheets of image receiving media substrates in a set with an objective of preventing individual sheets from propagating away from a process direction registration edge while stacking a set for stapling or compiling an unstapled set.

Exemplary embodiments may provide sets of rotating shelves that are with flat top surfaces that are individually discontinuous so a lead in ramp is located on side facing an output of an image receiving media processing or post-processing unit from which individual image receiving media substrates may be ejected. This configuration may be intended to substantially prevent a trail edge of individual image receiving media substrate sheets stubbing during an eject cycle from the image receiving media processing or post-processing unit.

In embodiments, the shelves may rotate 360 degrees to allow the sets to drop onto the elevator in a very short time period.

Exemplary embodiments may provide unique support structures in a form of multiple pairs of rotatable shelf elements that operate in unison to provide non-linear movement that facilitates vertical transport of individual image receiving media substrates and compiled sets of image receiving media substrates in an image forming device.

Exemplary embodiments may provide the multiple pairs of particularly-configured rotating shelves to both support the sheets of image receiving media during compiling as a completed set, and to serve as a controlled transport system for lowering the finished sets of image receiving media substrates onto a main internal set processing tray.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for improving stack registration with regard to sets of image receiving media substrates in an image receiving media processing or post-processing unit in an image forming device by employing a plurality of pairs of rotating shelf structures to implement substrate support and vertical set movement in the image forming device, will be described, in detail, with reference to the following drawings, in which.

DETAILED DESCRIPTION OF THE DISCLOSED EMBODIMENTS

Figure 1:
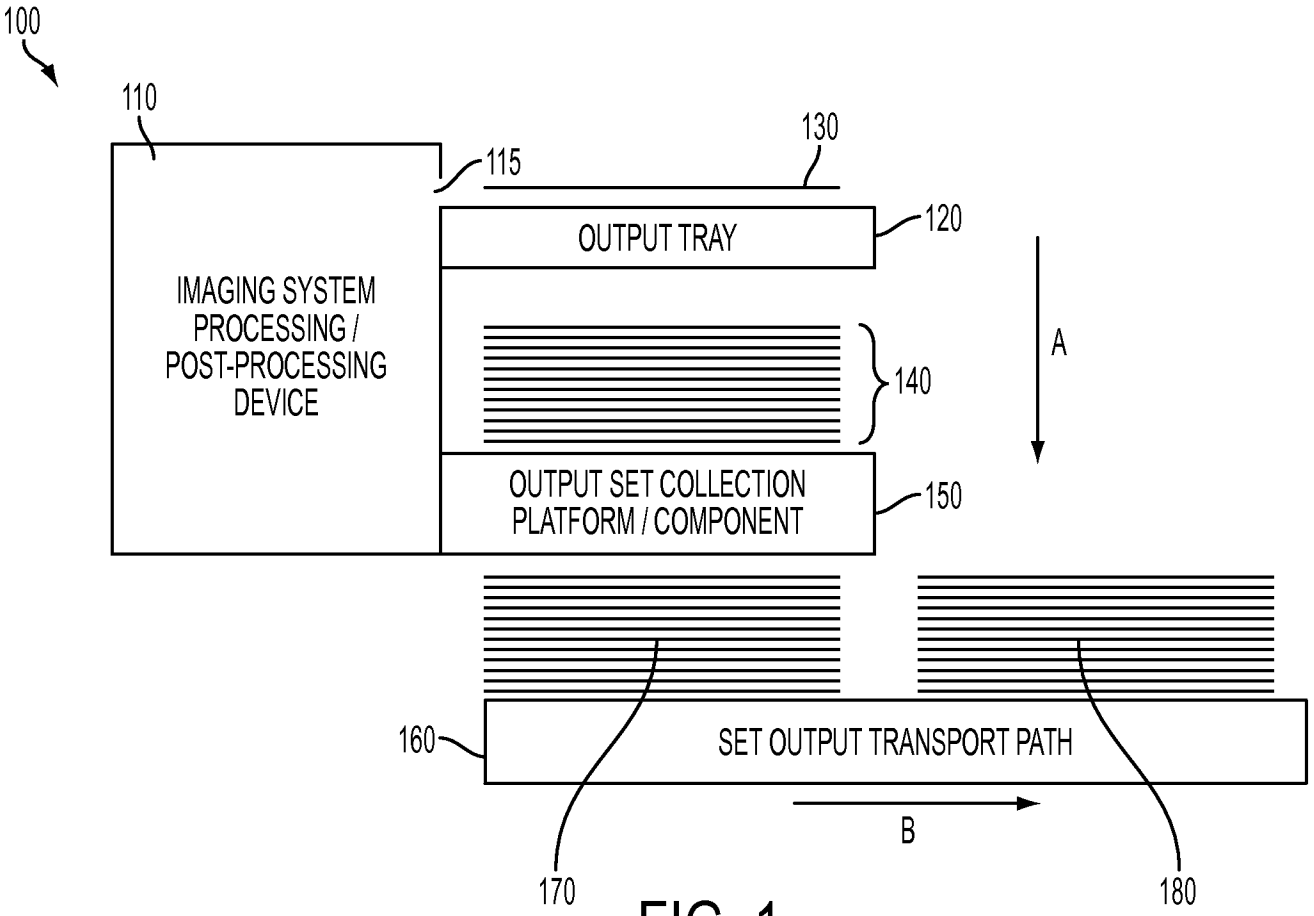
FIG. 1 RELATED ART
FIG. 1 illustrates a simple schematic representation of a side view of an exemplary related art system incorporating a commonly-implemented vertical compiler setup that may be improved upon using the systems and methods according to this disclosure.
Figure 2:
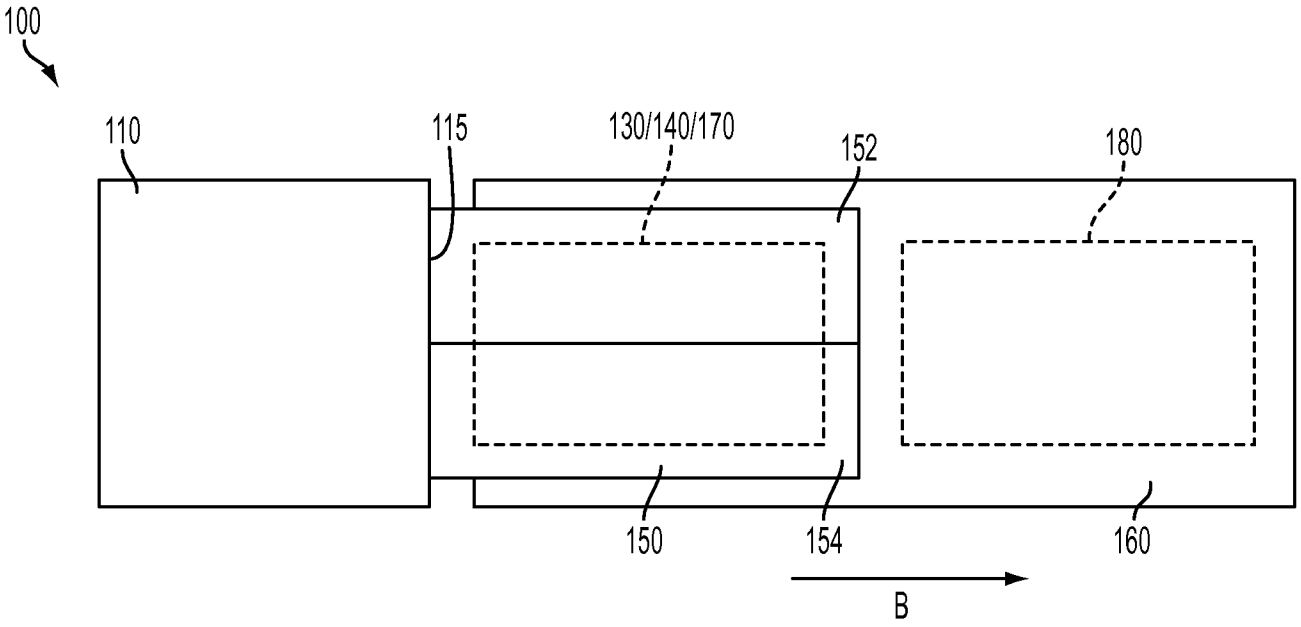
FIG. 2 RELATED ART
FIG. 2 illustrates a simple schematic representation of a plan view of the exemplary related art system incorporating the same commonly-implemented vertical compiler setup shown in FIG. 1.

The systems and methods for improving stack registration with regard to sets of image receiving media substrates in an image receiving media processing or post-processing unit in an image forming device by employing a plurality of pairs of rotating shelf structures to implement substrate support and vertical set movement in the image forming device according to this disclosure, will generally refer to this specific utility, configuration or function for those systems and methods. Exemplary embodiments described and depicted in this disclosure should not be interpreted as being specifically limited to any particular configuration of the described elements except insofar as individual rotating shelf structures as disclosed and depicted may provide unique top surfaces in support of the set compiling and dropping functions. Further, exemplary embodiments described and depicted in this disclosure should not be interpreted as being specifically directed to any particular intended use, including any particular functioning or operation of a processing, post-processing or other component device in an image forming system in which elements of the disclosed vertical image receiving media transport system or electro-mechanical rotating shelf vertical compiler unit may be advantageously employed.

Specific reference to, for example, various configurations of image forming systems and component devices within those systems, including post-processors and/or compilers, as those concepts and related terms are captured and used throughout this disclosure, should not be considered as limiting those concepts or terms to any particular configuration of the respective devices, the system configurations or the individual elements. The subject matter of this disclosure is intended to broadly encompass systems, devices, schemes and elements that may involve image forming and finishing operations, as those operations would be familiar to those of skill in the art. The disclosed concepts are particularly adapted to providing one or more vertical compiler systems in appropriate image receiving media transport paths, the vertical compiler systems being uniquely configured to incorporate a plurality of pairs of rotating shelf structures to implement substrate support in a first position and vertical set movement when moved to a second position.

The disclosed embodiments may specifically address shortfalls in conventional compilers in which compiled stack integrity is often compromised, particularly as speeds of image receiving media substrate through put increase, with rapidly linearly cycling support components introducing errors in the stacking and registration processes where lower sheets are often caused to migrate, or to "walk back," leading to errors in in-set registration in the process direction. Other errors are introduced as well in that, for example, as small stapled sets (<20 sheets) build up on a stack below, increased localized thicknesses due to stapling eventually build to a point where the stack can interfere with the compiling sets, causing further height differential and exacerbating the problem. For the reasons discussed above, earlier methods to mitigate these issues were of limited effectiveness for stated reasons, including being comprised of structures that may impose physical limits on page per minute throughput for the systems.

The disclosed embodiments may provide uniquely configured rotating structures, pairs of which may be configured to provide even support for sheets of image receiving media in the vertical compiler system. The particularly-configured set of rotating components may aid in reducing a tendency of lower sheets to migrate in a registration process, thereby thwarting the intent of the registration process requiring additional mechanical movements rather than fewer. In embodiments, a substantially entire length of the image receiving media substrate sheets being compiled is supported by providing appropriate numbers of pairs of rotating support structures, not necessarily limited to the two pairs of rotating shelf structures depicted and described generally below. In operation, as will be particularly shown with reference to FIGS. 3-5, the plurality of pairs of rotating shelf structures will be correctly positioned to implement substrate support with the plurality of pairs of rotating shelf structures in a first (support) position supporting the sheets of image receiving media substrate during compiling, and correctly positioned to implement vertical transport of the compiled sets of image receiving media substrates with the plurality of pairs of rotating shelf structures in a second (drop) position dropping compiled sets of image receiving media substrates onto a main internal set processing tray for further processing or output.

The disclosed systems and methods may incorporate a unique set of rotating shelves with top surfaces of each of the rotating shelves being preferably discontinuous with a lead-in ramp portion being located on an edge of the rotating shelves facing the image receiving media processing or post-processing unit from which the image receiving media substrates may be ejected after processing or post-processing. The respective lead-in ramps may be provided in an attempt to prevent the trail edge of sheets stubbing the plurality of pairs of rotating shelves structures during an eject cycle from the image receiving media processing or post-processing unit.

In certain conventional image forming systems, image receiving media substrates may enter what is conventionally understood to be a finishing/stacking portion via a vacuum transport mechanism in which a lead edge of a processed image receiving media substrate is adhered to the transport mechanism and the trail edge remains free to "float." The individual sheets of image receiving media substrates may then be stripped off and guided to a registration edge in an output position with respect to an exit/ejection port (or output throat) of an image receiving media processing or post-processing unit. A scuffer may nudge the individual sheets of image receiving media substrates against the registration edge. The individual sheets of image receiving media substrate may be lifted slightly as side tampers tamp the sheets or compiling sets. Additional sheets, as the set is compiled, may come in on top of the supported sheets as the cycle is repeated.

Figure 3:
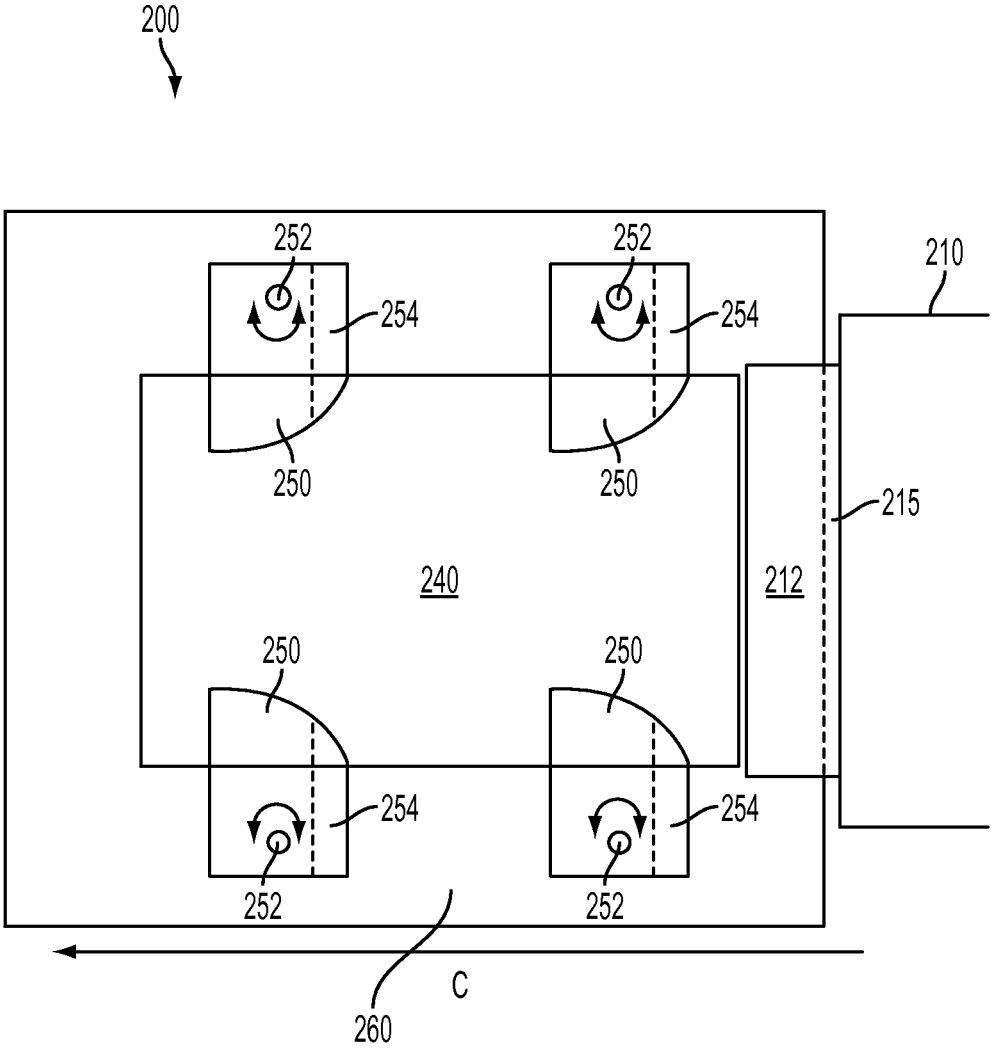
FIG. 3 illustrates a schematic diagram of a plan view of an exemplary image receiving media processing and transport system incorporating a particularly-configured vertical compiler section including a plurality of pairs of rotating shelf structures in a first (support) position according to this disclosure.
Figure 4:
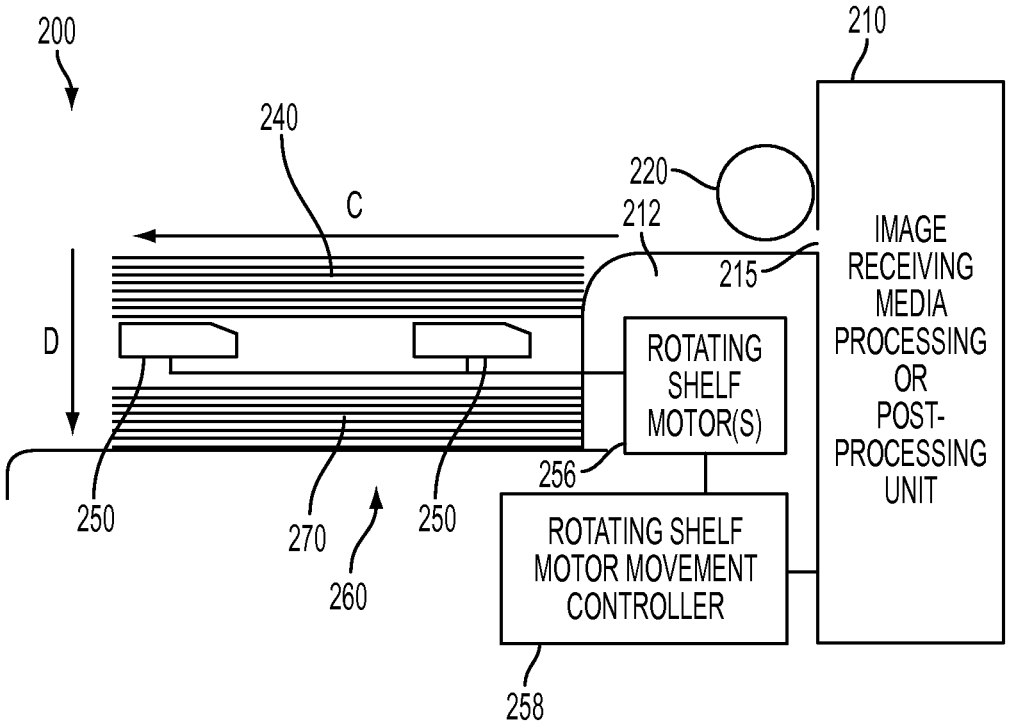
FIG. 4 illustrates a schematic diagram of a side view of the exemplary image receiving media processing and transport system shown in FIG. 3 incorporating the particularly-configured vertical compiler section including the plurality of pairs of rotating shelf structures in the first (support) position according to this disclosure.
Figure 5:
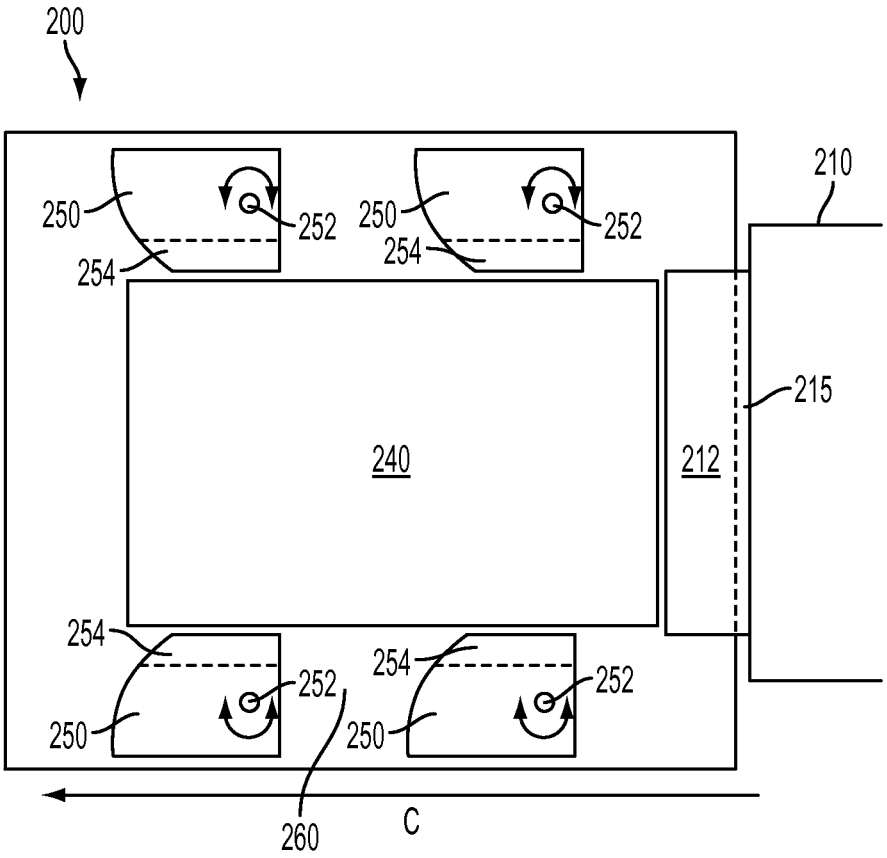
FIG. 5 illustrates a schematic diagram of a plan view of the exemplary image receiving media processing and transport system shown in FIG. 3 incorporating the particularly-configured vertical compiler section including the plurality of pairs of rotating shelf structures in a second (drop) position according to this disclosure.

FIG. 3 illustrates a schematic diagram of a plan view of an exemplary image receiving media processing and transport system 200 incorporating particularly-configured vertical compiler section including a plurality of pairs of rotating shelf structures in a first (support) position according to this disclosure. FIG. 4 illustrates a schematic diagram of a side view of the exemplary image receiving media processing and transport system 200, shown in FIG. 3, incorporating the particularly-configured vertical compiler section including the plurality of pairs of rotating shelf structures in the first (support) position according to this disclosure. FIG. 5 illustrates a schematic diagram of a plan view of the exemplary image receiving media processing and transport system, shown in FIG. 3, incorporating the particularly-configured vertical compiler section including the plurality of pairs of rotating shelf structures in a second (drop) position according to this disclosure.

As shown in FIGS. 3-5, the exemplary system 200 may uniquely provide a plurality of pairs of rotating shelf structures 250 to support multiple sheets 240 in a stack and prevent individual sheets from propagating away from the process direction registration edge of a compiler tray 212 while being compiled in a vicinity of an exit/ejection port 215 in an image receiving media processing or post-processing unit 210. There will be at least two pairs of rotating shelf structures 250 that will be particularly positioned and configured to support various length sheets of image receiving media substrates.

In embodiments, the top surfaces of the individual rotating shelf structures 250 may include a substantially flat portion with a 20-30 degree lead in portion 254 on the edges of the top surfaces of the individual rotating shelf structures 250 to allow the sheets of the image receiving media substrates to move in a process direction C from the compiler tray 212 without the trail edge hanging up. The flat top portions of the rotating shelf structures 250 will be level with stationary compiler tray 212 or up to an 8-12 degree angle to the height of compiler tray 212 for gravity assistance. This configuration will help to prevent individual sheets of image receiving media substrates from propagating away from the registration guide. The rotating shelf structures 250 may cycle 90 degrees about rotating shelf axes 252 between the first (support) position and the substantially orthogonal second (drop) position with respect to a rotating axes 252 for the rotating shelf structures 250, (see the arrows in FIGS. 3 and 5 and compare the depicted positions of the rotating shelf structures 250 shown in each instance), or may rotate 360 degrees, to allow compiled sets 240 of image receiving media substrates to drop onto a main internal set processing tray (or elevator) 260 below on which a set or sets 270 of image receiving media substrates may already have been collected. The rotating shelf structures 250 may be cycled between the first (support) position shown in FIG. 3 and the second (drop) position shown in FIG. 5, and back to get back in place to support the next set 240 of image receiving media substrates within a very short time period.

In embodiments, the rotating shelf structures 250 may have a small flat on the bottom of the lead-in which is perpendicular to flat supporting section of shelves 250 to help direct or funnel the sets 240 of sheets of image receiving media substrates onto the main internal set processing tray (or elevator) 260 below.

In embodiments, the image receiving media processing or post-processing unit 210 may offset stacks either inboard or outboard of a cross process centerline of compiler so that respective opposing (inboard and outboard) sets of rotating shelf structures 250 in each pair may be caused to rotate at different speeds to drop the set 240 of sheets of image receiving media substrates simultaneously for a fixed rotation position. If time permits, the rotating shelf structures 250 can slow down approaching the second (drop) position shown in FIG. 5 to improve cross process registration when dropped on the stacks of collected sets 270 of image receiving media substrates below.

The generic image receiving media processing or post-processing unit 210 shown in FIG. 4 is intended to represent, as appropriate, any one or more of a pre-conditioning device, marking module, post-processing device and/or other individual image receiving media substrate processing component, as may be associated with an image forming process in an image forming device or system. As mentioned briefly above, a scuffer 220 may be configured to induce movement of the image receiving media substrates in the direction C, until the image receiving media substrates are clear of the an exit/ejection port 215 in the image receiving media processing or post-processing unit 210. At the completion of the movement of the image receiving media substrates induced by the scuffer 220, the image receiving media substrates may be passed across the compiler tray 212, to be supported on flat top surfaces of the opposing pairs of particularly-configured rotating shelf structures 250.

One or more rotating shelf motor(s) 256, which may include stepper motor(s), may be used to drive the plurality of pairs rotating shelf structures 250 simultaneously. Regardless of whether a single rotating shelf motor 256 or multiple rotating shelf motors are used, operation of the rotating shelf motor(s) 256 may be under control of a rotating shelf motor movement controller 258 that may be used to control one or more of the linear motion induced by the scuffer 220, and all aspects of image receiving media substrate set handling by the rotating shelf structures 250.

Sheet transport from the image receiving media processing or post-processing unit 210 may be effected as each sheet of image receiving media substrate may be caused to enter a compile area or to pass over a compiler tray 212 of the image receiving media processing or post-processing unit 210 via, for example, a vacuum or other transport mechanism. As a leading edge of the first sheet of image receiving media substrate reaches the scuffer unit 220, the first sheet of image receiving media substrate may be pulled toward a registration edge. Where applicable, the vacuum may be turned off and the remaining length of the sheet of image receiving media substrate may be translated across compiler tray 212 in direction C and onto the plurality of pairs of rotating shelf structures 250 for support during set compiling.

In embodiments, the rotating shelf structures 250 may be caused to rotate a slight amount, in counter-rotating directions, preferably inward urging the lower-most sheets of image receiving media substrates back toward a registration wall (not shown), thereby substantially overcoming certain mis-registration errors, including those arising from the commonly understood phenomena of bounce-back, or other disadvantageous movement that may have been experienced by this first sheet of image receiving media substrate. The flat top surfaces on each of the rotating shelf structures 250 may allow for this small rotation to occur without affecting the planar attitude or vertical position of the compiling or accumulating set 240 of image receiving media substrates.

Once a set 240 of image receiving media substrates is completed, the rotating shelf structures 250 may be rotated through forces exerted on the rotating shelf structures 250 by the one or more rotating shelf motors 256 shown in FIG. 4. This motion of the rotating shelf structures 250 may serve to effect vertical movement of the set 240 of image receiving media substrates in direction D to deposit the most recently collected set 240 of image receiving media substrates on an already positioned set 270 of image receiving media substrates, or directly on an empty main internal set processing tray 260. It should be recognized that, the angled lead-in portions 254 on the edges of the top surfaces of the individual rotating shelf structures 250 may aid in the vertical movement of the set 240 of image receiving media substrates by providing a type of a funneling portion, or a type of a funneling effect, when the lead-in portions 254 are caused to turn inward so as to face each other (see FIG. 5). These configurations particularly come into play to uniquely effect the vertical movement of the set 240 of image receiving media substrates in direction D. Through continued cycling of the rotating shelf structures 250 respective sets 240 of image receiving media substrates may be sequentially deposited on the main internal set processing tray 260, to facilitate, for example, removal or, depending on a configuration, further transport from the main internal set processing tray 260 by additional lateral transport components to support further processing and/or output of the respective sets of image receiving media substrates in the image forming device or system with which the exemplary image receiving media processing and transport system 200, as shown in FIGS. 3-5, may be associated.

Among the objectives achieved by the disclosed configurations may be a unique advantage in that sheets of image receiving media substrates are supported at multiple points in a single plane, keeping the collected sets of image receiving media substrates comparatively flat during the collecting and compiling operations. A tendency of sheets of image receiving media substrates to migrate away from a registration wall or other alignment component, due to any slope being caused by the presence of, for example, stepped surfaces, may be substantially eliminated.

It should be noted that the rotating shelf motor movement controller 258 may be a stand-alone component, or may be a part or function of another processor or controller logic device in the image forming device or system with which the exemplary image receiving media processing and transport system 200 may be associated. The rotating shelf motor movement controller 258 may, for example, receive input signals as a print job is processed in the image forming system to determine when and how much to rotate the rotating shelf structures 250 at different stages in the depicted image receiving media transport process to complete the overall image forming process in the image forming system with which the exemplary image receiving media processing and transport system 200 may be associated.

Figure 6:
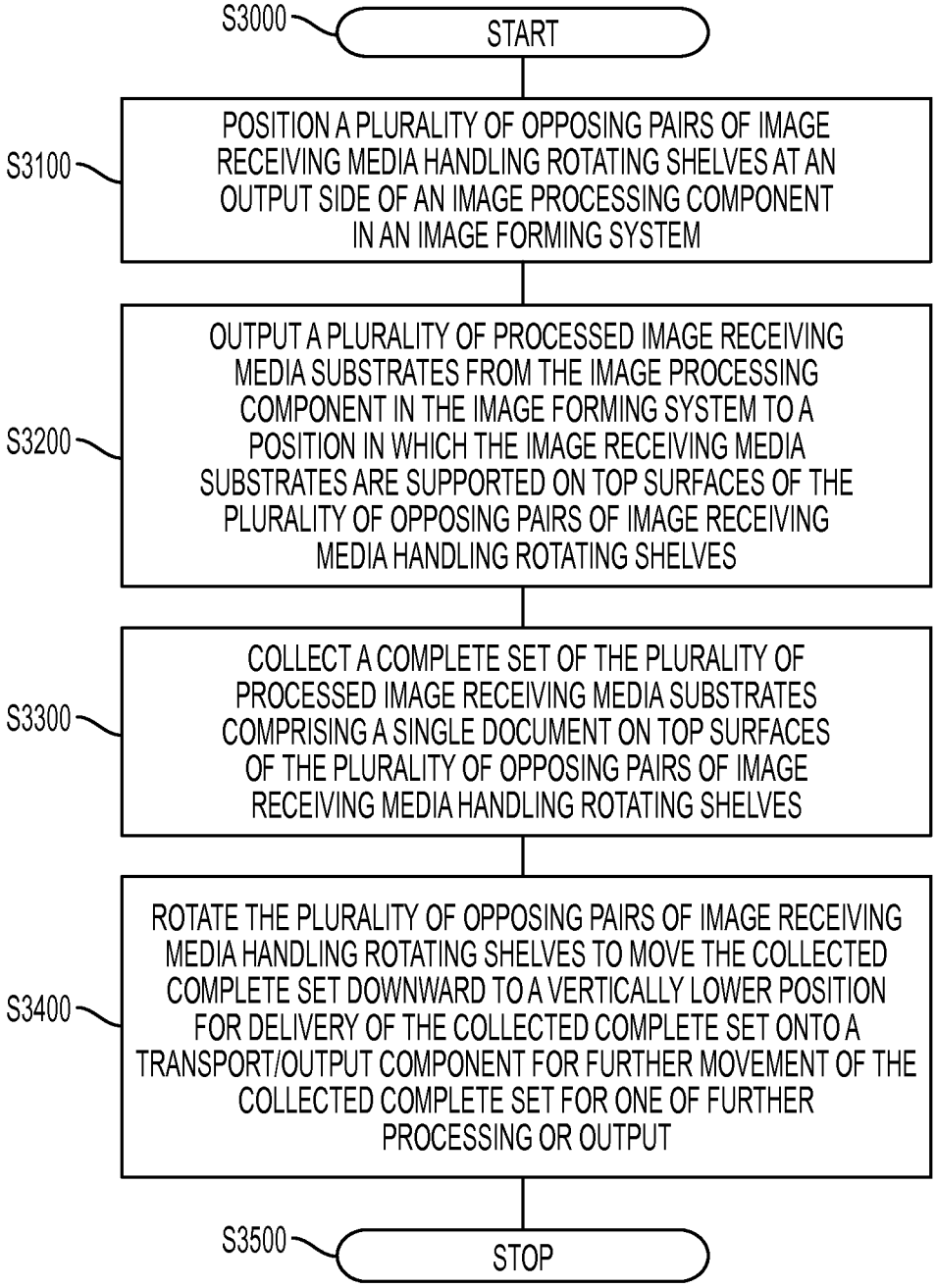
FIG. 6 illustrates a flowchart of an exemplary method for implementing a process for image receiving media transport in sets in a particularly-configured vertical compiler section based around a plurality of pairs of rotating shelf structures according to this disclosure.

The disclosed embodiments may include a method for implementing a process for image receiving media transport in sets in a particularly-configured vertical compiler section based around a plurality of pairs of rotating shelf components. FIG. 6 illustrates a flowchart of such an exemplary method. As shown in FIG. 6, operation of the method commences at Step S3000 and proceeds to Step S3100.

In Step S3100, a plurality of opposing pairs of rotating shelf structures, each having a uniquely-portioned top surface, may be provided and/or arranged in substantially co-planar alignment with a top surface of a conventional compiler tray/shelf at an output side of an image receiving media processing or post-processing unit, component or sub-system in an image forming system. The uniquely-portioned top surfaces may have a substantially-parallel top (supporting) portion and a ramped lead-in portion facing an exit/ejection port from the image receiving media processing or post-processing unit, component or sub-system in an effort to reduce any image receiving media substrate "stubbing" against a first of the plurality of pairs of rotating shelf structures in a process direction. Operation of the method proceeds to Step S3200.

In Step S3200, a plurality of processed image receiving media substrates may be output in order from the image receiving media processing or post-processing unit, component or sub-system in the image forming system to a position in which the image receiving media substrates are generally supported on the substantially-parallel top (supporting) portions of the uniquely-portioned top surfaces of the plurality of pairs of rotating shelf structures. Operation of the method proceeds to Step S3300.

In Step S3300, a complete set of the plurality of processed image receiving media substrates comprising a single document, according to a single print job assignment in the image forming system, may be collected on the substantially-parallel top (supporting) portions of the uniquely-portioned top surfaces of the plurality of pairs of rotating shelf structures. Operation of the method proceeds to Step S3400.

In Step S3400, a signal may be received via, for example, a rotating shelf motor movement controller that may be used to control one or more rotating shelf motor(s) to drive the plurality of pairs rotating shelf structures simultaneously to move the collected complete set of image receiving media substrates comprising the single document vertically downward to a vertically lower position for delivery of the collected complete set of image receiving media substrates onto a transport/output component for further movement of the collected complete sets of image receiving media substrates for one or more of further processing or output. Operation of the method proceeds to Step S3500, where operation of the method ceases.

The above-described exemplary systems and methods reference certain conventional components to provide a brief, general description of suitable document processing and post-processing means by which to carry out the disclosed image receiving media transport techniques in support of obtained image forming operations in the described image forming devices and systems. Those skilled in the art will appreciate that other embodiments of the disclosed subject matter may be practiced with many types and configurations of individual devices and combinations of devices particularly common to image forming and post-processing of image formed products in image forming devices and systems of varying complexity. No particular limitation to the variety or configuration of individual component devices included in image forming systems of varying complexity is to be inferred from the above description.

The exemplary depicted sequence of executable instructions represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 6, and the accompanying description, except where a particular method step is a necessary pre-condition to execution of any other method step. Individual method steps may be carried out in sequence or in parallel in simultaneous or near simultaneous timing, as appropriate.

Although the above description may contain specific details, they should not be construed as limiting the claims in any way. Other configurations of the described embodiments of the disclosed systems and methods are part of the scope of this disclosure.

It will be appreciated that a variety of the above-disclosed and other features and functions, or alternatives thereof, may be desirably combined into many other different systems or applications. Various alternatives, modifications, variations, or improvements therein may be subsequently made by those skilled in the art, which are also intended to be encompassed by the following claims.

We claim:

1. A method for handling image receiving media substrates in an image forming system, comprising:

providing a vertical compiler unit downstream at an output of an image receiving media substrate processing device as a transport mechanism for collecting a set of processed image receiving media substrates exiting the output of the image receiving media substrate processing device and for moving collected sets of processed image receiving media substrates from the output of the image receiving media substrate processing device, the vertical compiler unit comprising:

a plurality of pairs of rotating shelf structures as support and transport mechanisms in the vertical compiler unit, each of the rotating shelf structures having a top surface that includes a substantially planar portion that forms a substrate collection surface for image receiving media substrates exiting the output of the image receiving media substrate processing device, and at least one rotating shelf driving motor for driving the plurality of pairs of rotating shelf structures in a coordinated manner about respective vertical rotating shelf shafts for the plurality of pairs of rotating shelf structures;

wherein the top surface of at least one of the rotating shelf structures including an angled portion that falls away at an angle vertically from the substantially planar portion in a direction toward the image receiving media substrate processing device when the at least one of the rotating shelf structures is in an image receiving media substrate support position, wherein the angled portion guides the processed image receiving media substrates onto the substantially planar portion of the at least one of the rotating shelf structures while exiting the output, and wherein the angle is between 20 to 30 degrees;

providing a rotating shelf motor movement controller that controls movement of the transport of the image receiving media substrates exiting the output of the image receiving media substrate processing device including controlling operation of the at least one rotating shelf driving motor;

wherein the rotating shelf motor movement controller may be used to control one or more rotating shelf driving motor to drive the plurality of pairs rotating shelf structures simultaneously to move a collection of image receiving media substrates vertically downward to a vertically lower position for delivery substrates onto a transport/output component;

collecting the set of processed image receiving media substrates in a first position in which the set of processed image receiving media substrates are supported by the planar top surfaces of the plurality of pairs of rotating shelf structures;

receiving, with the rotating shelf motor movement controller, signals regarding image processing in the image receiving media substrate processing device indicating completion of the set of processed image receiving media substrates collected on the plurality of pairs of rotating shelf structures; and causing, with the rotating shelf motor movement controller, the at least one rotating shelf driving motor to operate to rotate the plurality of pairs of rotating shelf structures from the support position to the drop position to drop the set of processed image receiving media substrates from the first position to the second position;

wherein opposing rotating shelf structures among each pair of rotating shelf structures being rotated by the at least one rotating shelf driving motor in opposing counter-rotating directions.

2. The method of claim 1, wherein the rotating shelf motor movement controller causes a rotating shelf driving motor to the plurality of pairs of rotating shelf structures to urge a processed image receiving media substrates so as to facilitate alignment of the collected set of processed image receiving media substrates against an alignment surface associated with the image receiving media substrate processing device.

3. The method of claim 1, further comprising operating the plurality of pairs of rotating shelf structures to turn from a support position to a drop position to drop the collected set of processed image receiving media substrates from the first position to a second position in which the set of processed image receiving media substrates are deposited on a media handling surface in a vicinity of an exit position from the vertical compiler unit.

4. The method of claim 3, further comprising causing, with the rotating shelf motor movement controller, the at least one rotating shelf driving motor to operate to reposition the plurality of pairs of rotating shelf structures from the drop position back to the support position.

5. The method of claim 4, the plurality of pairs of rotating shelf structures being operated in the coordinated manner in a first direction about respective vertical rotating shelf shafts for the plurality of pairs of rotating shelf structures to move from the support position to the drop position; and being caused to continue to rotate in the first direction to reposition the plurality of pairs of rotating shelf structures from the drop position back to the support position.

6. The method of claim 4, the plurality of pairs of rotating shelf structures being operated in the coordinated manner in a first direction about respective vertical rotating shelf shafts for the plurality of pairs of rotating shelf structures to move from the support position to the drop position; and being caused to reverse rotation to a second direction opposite to the first direction to reposition the plurality of pairs of rotating shelf structures from the drop position back to the support position.

7. An image receiving media transport device, comprising:

a vertical compiler unit provided downstream of an output of an image receiving media substrate processing device in a process direction as a transport mechanism for collecting a set of processed image receiving media substrates exiting the output of the image receiving media substrate processing device and for moving collected sets of processed image receiving media substrates from the output of the image receiving media substrate processing device, the vertical compiler unit comprising:

a plurality of pairs of rotating shelf structures as support and transport mechanisms in the vertical compiler unit, and wherein the top surface of at least one of the rotating shelf structures including an angled portion that falls away at an angle vertically from the substantially planar portion in a direction toward the image receiving media substrate processing device when the at least one of the rotating shelf structures is in an image receiving media substrate support position, wherein the angled portion guides the processed image receiving media substrates onto the substantially planar portion of the at least one of the rotating shelf structures while exiting the output, and wherein the angle is between 20 to 30 degrees;

at least one rotating shelf driving motor for driving the plurality of pairs of rotating shelf structures in a coordinated manner about respective vertical rotating shelf shafts for the plurality of pairs of rotating shelf structures;

a rotating shelf motor movement controller that controls movement of the transport of the image receiving media substrates exiting the output of the image receiving media substrate processing device including controlling operation of the at least one rotating shelf driving motor;

wherein opposing rotating shelf structures among each pair of rotating shelf structures being rotated by the at least one rotating shelf driving motor in opposing counter-rotating directions; and a media handling surface in a vicinity of an exit position from the vertical compiler unit, sets of processed image receiving media substrates being collected in a first position in which the sets of processed image receiving media substrates are supported by planar top surfaces of the plurality of pairs of rotating shelf structures;

wherein the rotating shelf motor movement controller receiving signals regarding image processing in the image receiving media substrate processing device indicating completion of the set of processed image receiving media substrates collected on the plurality of pairs of rotating shelf structures, and causing the at least one rotating shelf driving motor to operate to rotate the plurality of pairs of rotating shelf structures from the support position to the drop position to drop the set of processed image receiving media substrates from the first position to the second position.

8. The device of claim 7, wherein the rotating shelf motor movement controller rotates the plurality of pairs of rotating shelf structures to urge a processed image receiving media substrates in a direction that causes alignment of the collected set of processed image receiving media substrates against an alignment surface associated with the image receiving media substrate processing device.

9. The device of claim 7, the rotating shelf motor movement controller controlling operation of the at least one rotating shelf driving motor to rotate the plurality of pairs of rotating shelf structures from a support position to a drop position to drop the collected set of processed image receiving media substrates from the first position to a second position in which the set of processed image receiving media substrates are deposited on the media handling surface.

10. The device of claim 8, the rotating shelf motor movement controller causing the at least one rotating shelf driving motor to operate to reposition the plurality of pairs of rotating shelf structures from the drop position back to the support position.

11. The device of claim 10, the plurality of pairs of rotating shelf structures being operated in the coordinated manner in a first direction about respective vertical rotating shelf shafts for the plurality of pairs of rotating shelf structures to move from the support position to the drop position, and being caused to continue to rotate in the first direction to reposition the plurality of pairs of rotating shelf structures from the drop position back to the support position.

12. The device of claim 10, the plurality of pairs of rotating shelf structures being operated in the coordinated manner in a first direction about respective vertical rotating shelf shafts for the plurality of pairs of rotating shelf structures to move from the support position to the drop position, and being caused to reverse rotation to a second direction opposite to the first direction to reposition the plurality of pairs of rotating shelf structures from the drop position back to the support position.

13. A system for processing image receiving media substrates, comprising:

at least one of an image receiving media substrate processing and post-processing device that executes one of substrate pre-processing, substrate conditioning, substrate marking, image fusing and document finishing;

a vertical compiler unit downstream at an output of the at least one of the image receiving media substrate processing and post-processing device as a transport mechanism for collecting a set of processed image receiving media substrates exiting the output of the at least one of the image receiving media substrate processing and post-processing device and for moving collected sets of processed image receiving media substrates from the output of the at least one of the image receiving media substrate processing and post-processing device, the vertical compiler unit comprising:

a plurality of pairs of rotating shelf structures as support and transport mechanisms in the vertical compiler unit, at least one rotating shelf driving motor for driving the plurality of pairs of rotating shelf structures in a coordinated manner about respective vertical rotating shelf shafts for the plurality of pairs of rotating shelf structures, and wherein the top surface of at least one of the rotating shelf structures including an angled portion that falls away at an angle vertically from the substantially planar portion in a direction toward the image receiving media substrate processing device when the at least one of the rotating shelf structures is in an image receiving media substrate support position, wherein the angled portion guides the processed image receiving media substrates onto the substantially planar portion of the at least one of the rotating shelf structures while exiting the output, and wherein the angle is between 20 to 30 degrees;

a rotating shelf motor movement controller that controls movement of the transport of the processed image receiving media substrates exiting the output of the at least one of the image receiving media substrate processing and post-processing device including controlling operation of the at least one rotating shelf driving motor; and wherein opposing rotating shelf structures among each pair of rotating shelf structures being rotated by the at least one rotating shelf driving motor in opposing counter-rotating directions; and a media handling surface in a vicinity of an exit position from the vertical compiler unit, sets of processed image receiving media substrates being collected in a first position in which the sets of processed image receiving media substrates are supported by planar top surfaces of the plurality of pairs of rotating shelf structures;

wherein the rotating shelf motor movement controller receiving signals regarding image processing in the image receiving media substrate processing device indicating completion of the set of processed image receiving media substrates collected on the plurality of pairs of rotating shelf structures, and causing the at least one rotating shelf driving motor to operate to rotate the plurality of pairs of rotating shelf structures from the support position to the drop position to drop the set of processed image receiving media substrates from the first position to the second position.

14. The system of claim 13, the rotating shelf motor movement controller controlling operation of the at least one rotating shelf driving motor to rotate the plurality of pairs of rotating shelf structures from a support position to a drop position to drop the collected set of processed image receiving media substrates from the first position to a second position in which the set of processed image receiving media substrates are deposited on the media handling surface.

* * * * *